US008096757B2

(12) United States Patent
Snook et al.

(10) Patent No.: US 8,096,757 B2
(45) Date of Patent: Jan. 17, 2012

(54) METHODS AND APPARATUS FOR REDUCING NOZZLE STRESS

(75) Inventors: Daniel David Snook, Moore, SC (US); Edward Durell Benjamin, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 526 days.

(21) Appl. No.: 12/348,106

(22) Filed: Jan. 2, 2009

(65) Prior Publication Data

US 2010/0172748 A1 Jul. 8, 2010

(51) Int. Cl.
*F01D 9/02* (2006.01)

(52) U.S. Cl. ..... 415/191; 415/208.1; 29/889.22

(58) Field of Classification Search ..... 415/191, 415/208.1, 208.2, 210.1, 211.2; 29/889.22
See application file for complete search history.

(56) References Cited

U.S. PATENT DOCUMENTS

| | | | | |
|---|---|---|---|---|
| 4,126,405 | A | 11/1978 | Bobo et al. | |
| 5,174,715 | A | 12/1992 | Martin | |
| 6,390,775 | B1 | 5/2002 | Paz | |
| 6,823,677 | B2 * | 11/2004 | Prociw et al. | 60/800 |
| 6,951,447 | B2 | 10/2005 | Cherolis et al. | |
| 7,229,245 | B2 | 6/2007 | Ellis et al. | |
| 7,651,318 | B2 * | 1/2010 | Suga et al. | 415/178 |
| 2004/0261417 | A1 * | 12/2004 | Yamashita et al. | 60/679 |
| 2009/0308957 | A1 * | 12/2009 | Hall | 239/590 |
| 2011/0048023 | A1 * | 3/2011 | Patel et al. | 60/748 |

* cited by examiner

*Primary Examiner* — Gary F. Paumen
(74) *Attorney, Agent, or Firm* — Armstrong Teasdale LLP

(57) ABSTRACT

A gas turbine engine nozzle is described. The gas turbine engine nozzle includes at least one nozzle vane having a first end and a second end. The first end is coupled to an inner sidewall and the second end is coupled to an outer sidewall. The gas turbine engine nozzle also includes at least one stress relief pocket defined within at least one of the inner sidewall and the outer sidewall proximate to the at least one nozzle vane. The at least one stress relief pocket is configured to reduce stress on the proximate nozzle vane.

20 Claims, 6 Drawing Sheets

METHODS AND APPARATUS FOR REDUCING NOZZLE STRESS

BACKGROUND OF THE INVENTION

The field of the disclosure relates generally to gas turbine engines, and more specifically, to methods and apparatus for reducing nozzle stress in a gas turbine engine.

A gas turbine engine generally includes in serial flow communication a compressor, a combustor, and a turbine. The compressor provides compressed airflow to the combustor wherein the airflow is mixed with fuel and ignited, which creates combustion gases. The combustion gases flow to the turbine which extracts energy therefrom.

The turbine includes one or more stages, with each stage having an annular turbine nozzle set for channeling the combustion gases to a plurality of rotor blades. The turbine nozzle set includes a plurality of circumferentially spaced nozzles fixedly joined at their roots and tips to a radially inner sidewall and a radially outer sidewall, respectively. Each individual nozzle has an airfoil cross-section and includes a leading edge, a trailing edge, and pressure and suction sides extending therebetween. Typically, a useful life of a nozzle is limited to the life of the nozzle trailing edge. This is at least partially caused by a large strain range that the trailing edge passes through during engine start-up and shut-down. For example, exposure to changing temperatures, in combination with the varying thickness of each nozzle, causes strain on the nozzle that may reduce a useful life of the nozzle.

BRIEF DESCRIPTION OF THE INVENTION

In one aspect, a gas turbine engine nozzle is provided. The nozzle includes at least one nozzle vane including a first end and a second end. The first end is coupled to an inner sidewall and the second end is coupled to an outer sidewall. The nozzle also includes at least one stress relief pocket defined within at least one of the inner sidewall and the outer sidewall and proximate to the at least one nozzle vane. The at least one stress relief pocket facilitates reducing stress induced to said nozzle vane.

In another aspect, a gas turbine engine including at least one turbine stage is provided. The at least one turbine stage includes a plurality of turbine blades and a nozzle set positioned upstream from the plurality of turbine blades. The nozzle set is configured to channel airflow downstream to the turbine blades. The nozzle set includes at least one stress relief pocket configured to reduce stresses induced to the nozzle set.

In yet another aspect, a method for reducing nozzle stress is provided. The method includes providing a plurality of nozzles, each nozzle including an inner sidewall and an outer sidewall, and at least one nozzle vane that extends therebetween. At least one of the plurality of nozzles includes at least one stress relief pocket defined within at least one of the inner sidewall and the outer sidewall. The method also includes positioning the plurality of nozzles to form an annular nozzle set.

DETAILED DESCRIPTION OF THE INVENTION

Figure 1:
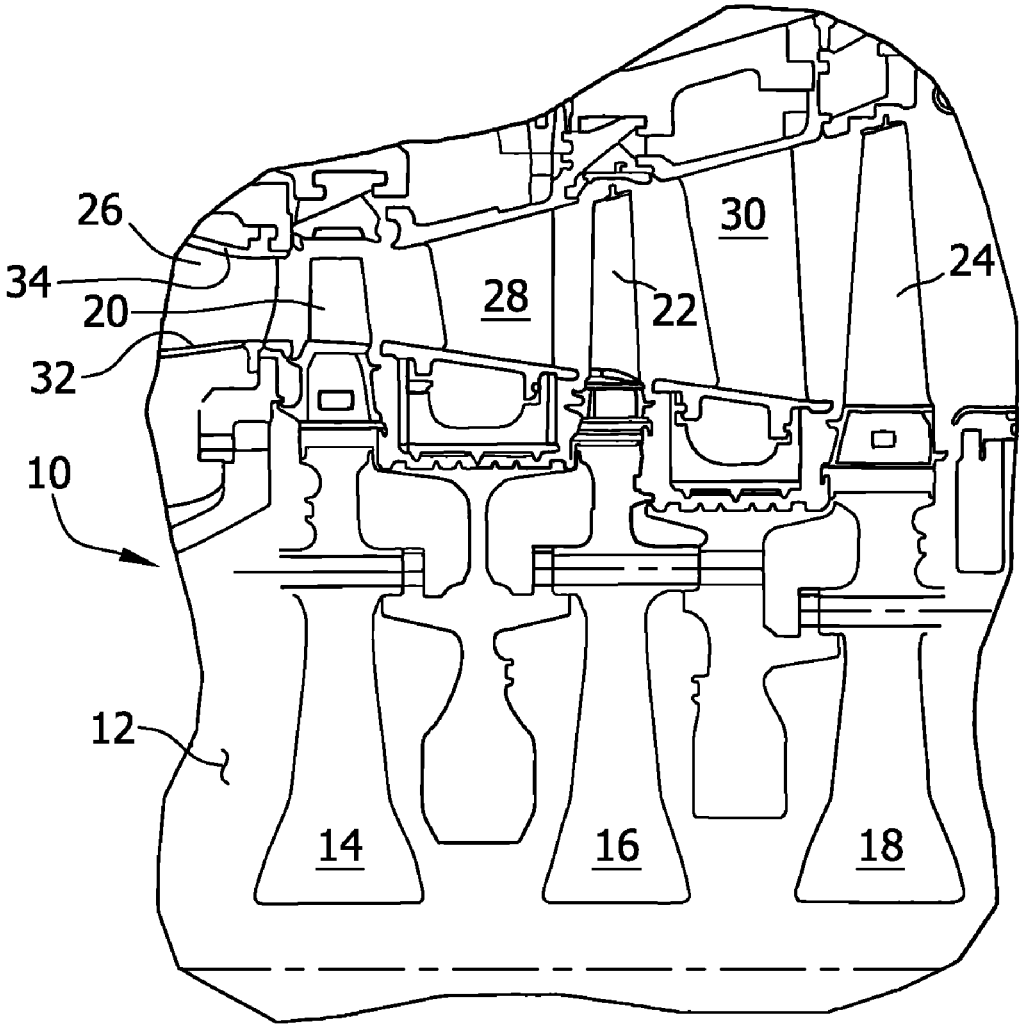
FIG. 1 is a schematic cross-sectional illustration of an exemplary turbine including a first stage nozzle set.

FIG. 1 illustrates a cross-sectional view of an exemplary turbine 10. In the exemplary embodiment, turbine 10 includes a rotor 12 having respective first, second, and third stage rotor wheels 14, 16, and 18 that include respective buckets 20, 22, and 24 and respective nozzles 26, 28, and 30. Each row of buckets 20, 22, and 24 and nozzles 26, 28, and 30, defines a subsequent stage of turbine 10. In the exemplary embodiment, turbine 10 is a three stage turbine. Alternatively, turbine 10 may include more or less than three stages. In one embodiment, turbine 10 is a General Electric 7FA+e gas turbine, manufactured by General Electric Company of Schenectady, N.Y.

Within the first turbine stage, a plurality of buckets, including bucket 20, are spaced circumferentially about first stage rotor wheel 14. The plurality of buckets, including bucket 20, are mounted in axial opposition to an upstream nozzle set, which includes nozzle 26. The plurality of nozzles, including nozzle 26, that form the upstream nozzle set, are spaced circumferentially about an inner sidewall 32 and extend radially between inner sidewall 32 and an outer sidewall 34.

Figure 2:
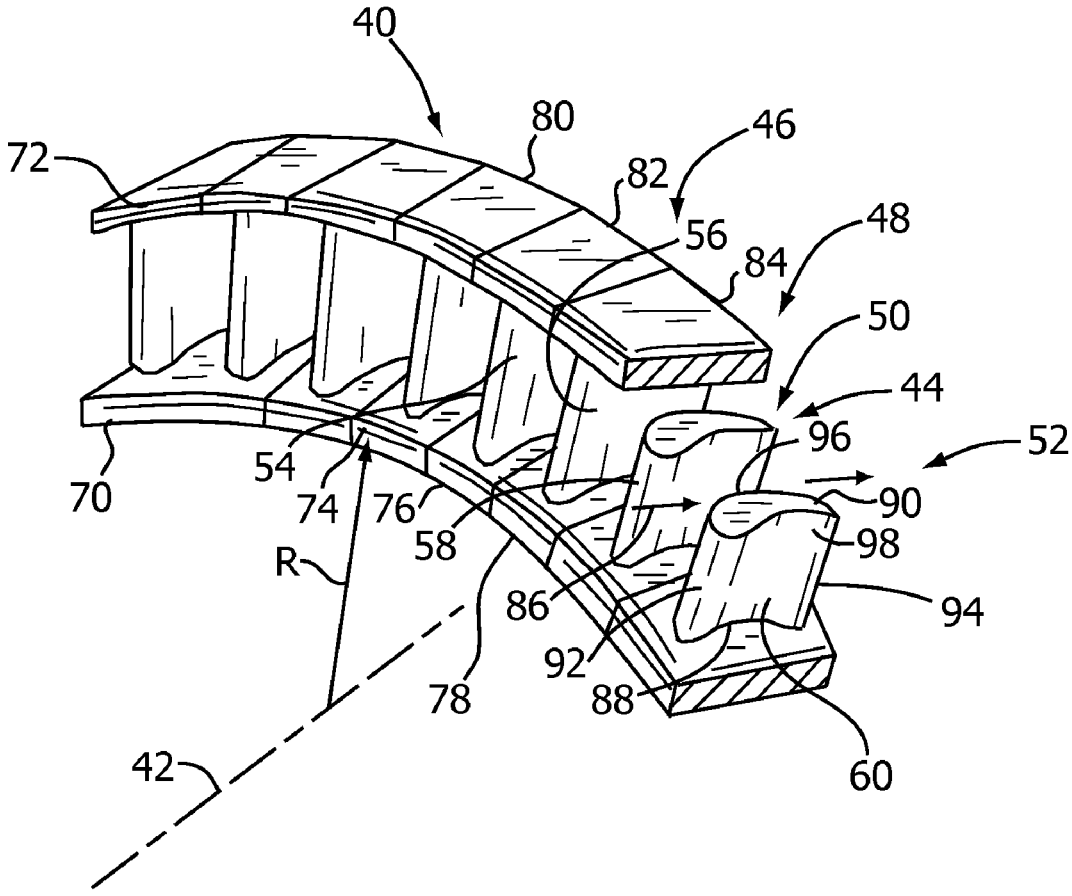
FIG. 2 is a perspective view of a portion of an annular gas turbine engine nozzle set.

FIG. 2 is a perspective view of a portion of an annular gas turbine engine nozzle set 40. Nozzle set 40 is disposed coaxially about a longitudinal, or axial, centerline 42 of a turbine, for example, turbine 10 (shown in FIG. 1). Nozzle set 40 includes a plurality of circumferentially spaced nozzles 44, including, for example, nozzle 46, nozzle 48, nozzle 50, and nozzle 52. Nozzles 46, 48, 50, and 52 include nozzle vanes 54, 56, 58, and 60, respectively. Nozzle vanes 54, 56, 58, and 60 are coupled to radially inner and outer annular sidewalls 70 and 72. In the exemplary embodiment, inner annular sidewall 70 includes a plurality of sidewall portions, for example, sidewall portions 74, 76, and 78, which are coupled together to form inner annular sidewall 70. Similarly, in the exemplary embodiment, outer annular sidewall 72 includes a plurality of sidewall portions, for example, sidewall portions 80, 82, and 84, which are coupled together to form outer annular sidewall 72. For example, nozzle vane 54 is coupled to inner sidewall portion 76 and outer sidewall portion 82.

Inner sidewall 70 has an inner radius R relative to axial centerline 42 for positioning nozzles 46, 48, 50, and 52 inline with combustion gases 86 channeled thereto from a gas turbine engine combustor (not shown in FIG. 2). Nozzle set 40 may be any turbine nozzle set, including, but not limited to a first stage nozzle set, used in a turbine engine.

In the exemplary embodiment, each individual nozzle vane 54, 56, 58, and 60 includes a root 88 coupled to inner sidewall 70, and a tip 90 coupled to outer sidewall 72. Each of nozzle vanes 54, 56, 58, and 60 also includes a leading edge 92 facing in an upstream direction and a trailing edge 94 facing in a downstream direction. Each leading edge 92 is circumferentially thicker than the corresponding trailing edge 94. A suction, or convex side 96, is located opposite to a pressure, or concave side 98.

Figure 3:
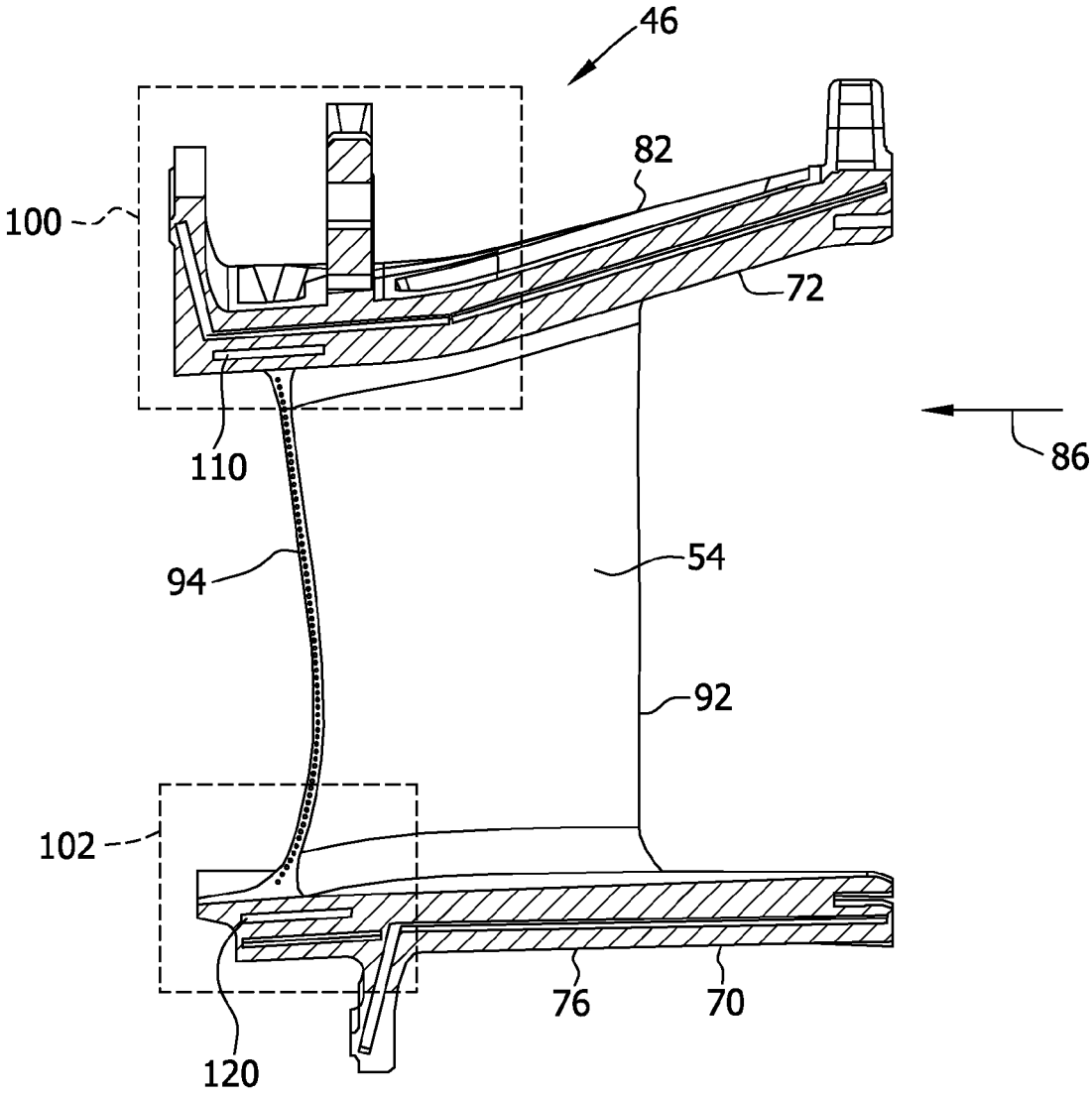
FIG. 3 is a cross-sectional illustration of an exemplary nozzle.
Figure 4:
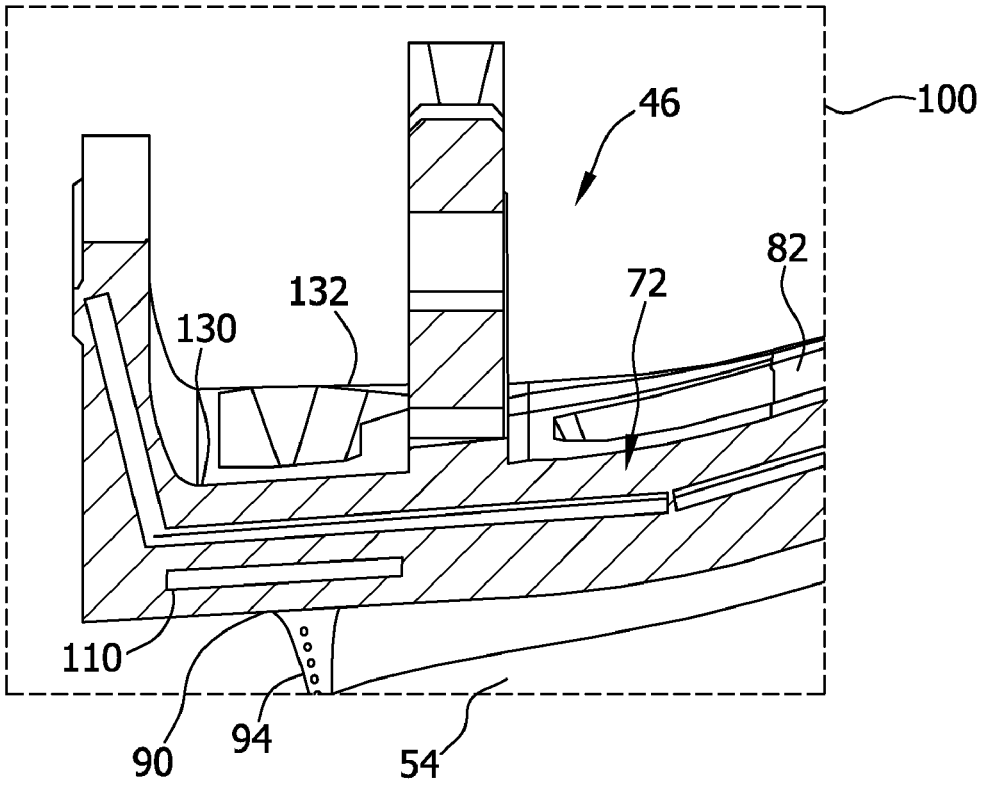
FIG. 4 is a cross-sectional illustration of a portion of the nozzle shown in FIG. 3.
Figure 5:
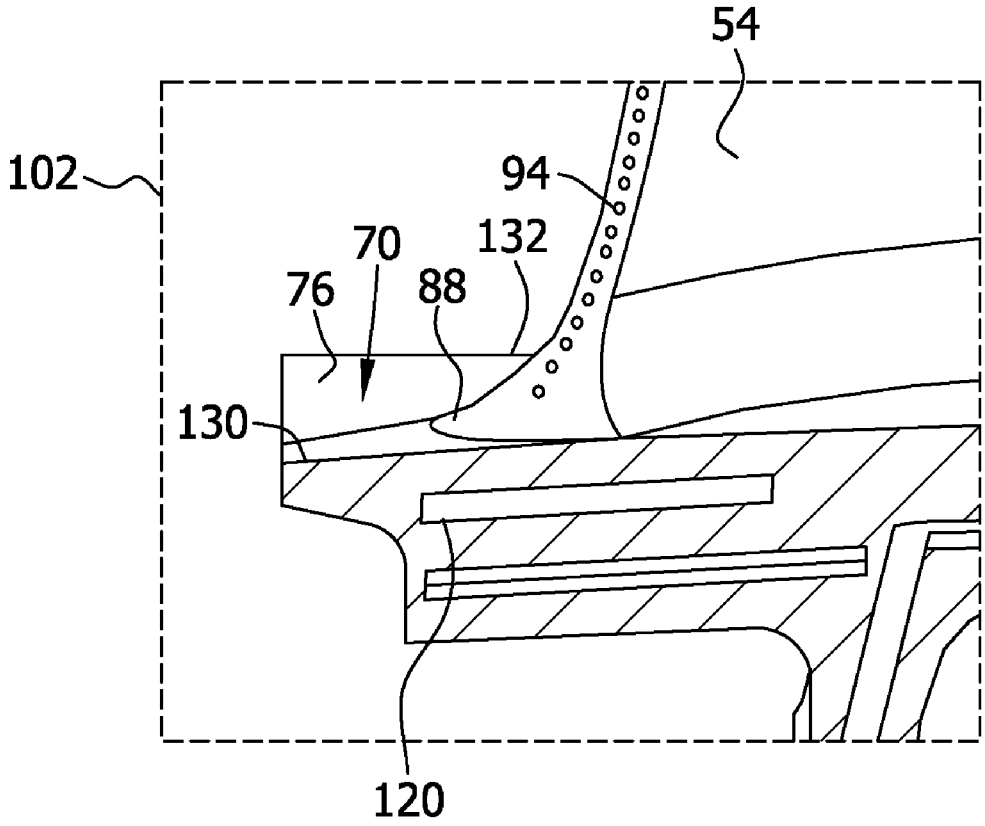
FIG. 5 is a cross-sectional illustration of a portion of the nozzle shown in FIG. 3.

FIG. 3 is a cross-sectional illustration of an exemplary nozzle, for example, nozzle 46 (shown in FIG. 2). FIG. 4 is a cross-sectional illustration of a portion 100 (shown in FIG. 3) of nozzle 46 (shown in FIG. 3). FIG. 5 is a cross-sectional illustration of a portion 102 (shown in FIG. 3) of nozzle 46

(shown in FIG. 3). Referring now to FIGS. 3, 4, and 5, in the exemplary embodiment, nozzle 46 includes nozzle vane 54, which extends radially between inner sidewall 70 and outer sidewall 72. More specifically, nozzle vane 54 extends radially between inner sidewall portion 76 and outer sidewall portion 82. Nozzle vane 54 includes a leading edge 92 and a trailing edge 94. Combustion gases 86 are channeled past nozzle vane 54 from upstream of turbine 10 (shown in FIG. 1).

In the exemplary embodiment, nozzle 46 includes a stress relief pocket 110 within outer sidewall portion 82 and a stress relief pocket 120 defined within inner sidewall portion 76. In the exemplary embodiment, stress relief pockets 110 and 120 are openings defined within outer sidewall portion 82 and inner sidewall portion 76, respectively. In the exemplary embodiment, material forming outer sidewall portion 82 is removed to form stress relief pocket 110. For example, stress relief pocket 110 may be formed using an electromachining process such as electrical discharge machining. Stress relief pocket 110 may also be formed within outer sidewall portion 82 during a casting process or using a conventional machining process. Stress relief pocket 120 is formed in substantially the same manner as stress relief pocket 110. Stress relief pockets 110 and 120 may be formed within outer sidewall portion 82 and inner sidewall portion 76 using any process that enables nozzle 46 to operate as described herein.

In the exemplary embodiment, stress relief pocket 110 is an opening that extends from a first edge 130 of outer sidewall portion 82 towards a second edge 132 of outer sidewall portion 82, without extending through outer sidewall portion 82. In other words, in the exemplary embodiment, stress relief pocket 110 does not extend through outer sidewall portion 82 from first edge 130 to second edge 132. Stress relief pocket 120 is configured substantially similarly. Although described herein as extending partially between first edge 130 and second edge 132, stress relief pockets 110 and 120 may extend any depth into sidewall portions 76 and 82, including extending between first and second edge 130 and 132, that enable stress relief pockets 110 and 120 to function as described herein. Also, although illustrated as rectangular openings, stress relief pockets 110 and 120 may include any shape or size that enable stress relief pockets 110 and 120 to function as described herein. For example, a length, depth, and height of stress relief pockets 110 and 120 may be optimized to maximize stress reduction while minimizing other impacts on nozzle 46.

In the exemplary embodiment, stress relief pocket 110 is defined within outer sidewall 72, proximate to trailing edge 94 of nozzle vane 54. Similarly, stress relief pocket 120 is defined within inner sidewall 70, proximate to trailing edge 94 of nozzle vane 54. More specifically, stress relief pocket 110 is defined radially outward from tip 90 of nozzle vane 54 and stress relief pocket 120 is defined radially inward from root 88 of nozzle vane 54.

As described above, trailing edge 94 is thinner than leading edge 92. The different amount of material present along trailing edge 94 compared to leading edge 92 causes temperature changes to effect trailing edge 94 differently than leading edge 92. The temperature changes that occur during engine start-up and engine shut-off may cause stress, also referred to herein as strain, on nozzle 46. This strain may include compressive strain and/or tensile strain. For example, during engine start-up, as hot combustion gases flow past nozzle vane 54 that was previously at an ambient temperature, trailing edge 94 heats faster than leading edge 92. This heating causes a greater expansion of trailing edge 94 and therefore a greater compression occurs between trailing edge 94 and sidewalls 70 and 72 than between leading edge 92 and sidewalls 70 and 72. Conversely, during engine shut-down, trailing edge 94 cools more rapidly than leading edge 92. This cooling causes a greater contraction of trailing edge 94 and therefore a greater tension at trailing edge 94 than at leading edge 92. Stress relief pockets 110 and 120 facilitate increasing a flexibility of sidewalls 70 and 72 at trailing edge 94, and thereby facilitate reducing a magnitude of both compressive and tensile portions of total strain.

Figure 6:
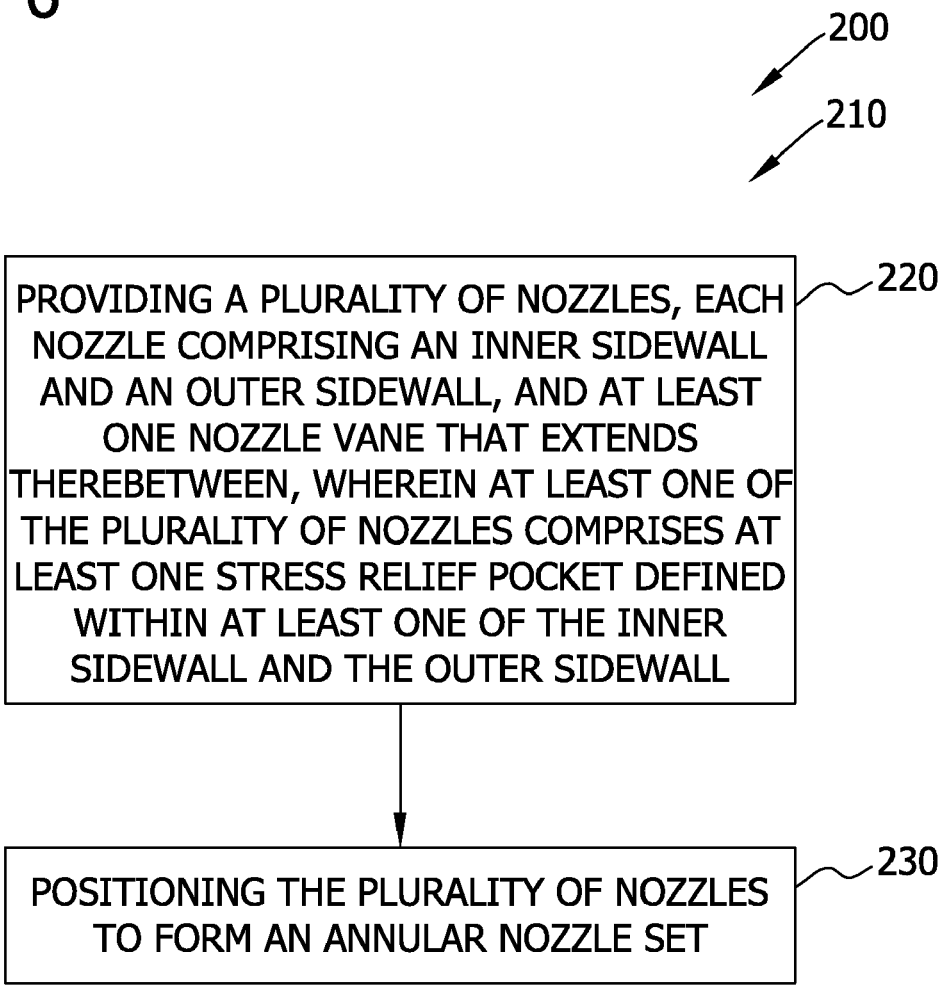
FIG. 6 is a flowchart of an exemplary method for reducing nozzle stress.

FIG. 6 is a flowchart 200 of an exemplary method 210 for reducing nozzle stress. In an exemplary embodiment, flowchart 200 is a method 210 for reducing stress on nozzle 46 (shown in FIG. 3). Method 210 includes providing 220 a plurality of nozzles, wherein each nozzle includes an inner sidewall and an outer sidewall, and at least one nozzle vane that extends therebetween. Furthermore, at least one of the plurality of nozzles comprises at least one stress relief pocket defined within at least one of the inner sidewall and the outer sidewall. For example, method 210 may include providing nozzles 46, 48, 50, and 52 (shown in FIG. 2), which include, for example, stress relief pocket 110 (shown in FIG. 3). Method 210 also includes positioning 230 the plurality of nozzles to form an annular nozzle set.

In some examples, providing 220 a plurality of nozzles may further include providing 220 stress relief pocket 110 within outer sidewall 72, radially outward from nozzle vane 54 (shown in FIG. 3). Furthermore, providing 220 a plurality of nozzles may include providing 220 stress relief pocket 120 within inner sidewall 70, radially inward from nozzle vane 54 (shown in FIG. 3). Providing 220 a plurality of nozzles having at least one stress relief pocket facilitates increasing a useful life of the nozzles and lowering a stress level at an interface between the nozzle vanes and the sidewall.

Furthermore, providing 220 a plurality of nozzles comprising at least one stress relief pocket may include forming the at least one stress relief pocket using at least one of an electromachining process and a conventional machining process. Providing 220 may also include forming the at least one stress relief pocket during casting of the sidewalls.

The methods and apparatus described herein facilitate a reliable and cost effective reduction of stress on a gas turbine engine nozzle. The methods and apparatus described herein facilitate increasing sidewall flexibility at a trailing edge of each nozzle, which reduces the stress on the trailing edge caused by temperature changes within the turbine stage. The reduction of stress on the trailing edge facilitates a reduction in nozzle repairs and an increase in a nozzle repair interval, while adding only minor increases in component machining costs.

Exemplary embodiments of methods and apparatus for reducing stress on a gas turbine engine nozzle are described above in detail. The methods and apparatus are not limited to the specific embodiments described herein, but rather, components of apparatus and/or steps of the methods may be utilized independently and separately from other components and/or steps described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A gas turbine engine nozzle comprising:

at least one nozzle vane comprising a first end and a second end, said first end coupled to an inner sidewall, said second end coupled to an outer sidewall; and at least one stress relief pocket defined within at least one of said inner sidewall and said outer sidewall and proximate to said at least one nozzle vane, said at least one stress relief pocket facilitates reducing stress induced to said nozzle vane.

2. A gas turbine engine nozzle in accordance with claim 1, wherein said at least one nozzle vane further comprises a leading edge and a trailing edge, and wherein said at least one stress relief pocket is defined proximate to said trailing edge.

3. A gas turbine engine nozzle in accordance with claim 1, wherein said at least one stress relief pocket comprises at least one of an eliptical and a rectangular cross-sectional shape.

4. A gas turbine engine nozzle in accordance with claim 1, wherein said at least one stress relief pocket facilitates increasing a useful life of said nozzle.

5. A gas turbine engine nozzle in accordance with claim 1, wherein said at least one stress relief pocket is formed using at least one of an electromachining process and a conventional machining process.

6. A gas turbine engine nozzle in accordance with claim 1, wherein said at least one stress relief pocket is defined within at least one of said inner sidewall and said outer sidewall during casting of said sidewalls.

7. A gas turbine engine comprising at least one turbine stage, said at least one turbine stage comprising:

a plurality of turbine blades;

a nozzle set positioned upstream from said plurality of turbine blades, said nozzle set configured to channel airflow downstream to said turbine blades, said nozzle set comprising at least one stress relief pocket configured to reduce stresses induced to said nozzle set.

8. A gas turbine engine in accordance with claim 7, wherein said nozzle set comprises a plurality of nozzles, each of said plurality of nozzles comprises at least one nozzle vane comprising a first end and a second end, said first end coupled to an inner sidewall, said second end coupled to an outer sidewall, said at least one stress relief pocket is positioned within at least one of said inner sidewall and said outer sidewall.

9. A gas turbine engine in accordance with claim 8, wherein said at least one stress relief pocket is positioned proximate to said at least one nozzle vane.

10. A gas turbine engine in accordance with claim 7, wherein each of said plurality of nozzles comprises at least one nozzle vane comprising a leading edge and a trailing edge, said at least one stress relief pocket is positioned proximate to said trailing edge.

11. A gas turbine engine in accordance with claim 7, wherein said at least one stress relief pocket is formed using at least one of an electromachining process and a conventional machining process.

12. A gas turbine engine in accordance with claim 7, wherein said at least one stress relief pocket is defined within at least one of said inner sidewall and said outer sidewall during casting of said sidewalls.

13. A gas turbine engine in accordance with claim 7, wherein said at least one stress relief pocket comprises at least one of an elliptical and a rectangular cross-sectional shape.

14. A method for reducing nozzle stress, said method comprising:

providing a plurality of nozzles within a gas turbine stage, each nozzle comprising an inner sidewall and an outer sidewall, and at least one nozzle vane that extends therebetween, wherein at least one of the plurality of nozzles comprises at least one stress relief pocket defined within at least one of the inner sidewall and the outer sidewall; and positioning the plurality of nozzles to form an annular nozzle set.

15. A method in accordance with claim 14, wherein providing a plurality of nozzles further comprises providing the at least one stress relief pocket within the outer sidewall radially outward from the at least one nozzle vane.

16. A method in accordance with claim 14, wherein providing a plurality of nozzles further comprises providing the at least one stress relief pocket within the inner sidewall radially inward from the at least one nozzle vane.

17. A method in accordance with claim 14, wherein providing a plurality of nozzles further comprises forming the at least one stress relief pocket using at least one of an electromachining process and a conventional machining process.

18. A method in accordance with claim 14, wherein providing a plurality of nozzles further comprises forming the at least one stress relief pocket during casting of the sidewalls.

19. A method in accordance with claim 14, wherein providing a plurality of nozzles, wherein at least one of the plurality of nozzles comprises at least one stress relief pocket, facilitates increasing a useful life of the nozzles.

20. A method in accordance with claim 14, wherein providing a plurality of nozzles, wherein at least one of the plurality of nozzles comprises at least one stress relief pocket, facilitates lowering a stress level at an interface between each nozzle vane and the sidewall.

* * * * *